US006953327B1

(12) United States Patent
Hauser et al.

(10) Patent No.: US 6,953,327 B1
(45) Date of Patent: Oct. 11, 2005

(54) DUAL PUMP

(75) Inventors: Raymond Hauser, Sullivan, IL (US); Lonnie E. Holder, Sullivan, IL (US); Scott W. Keller, Charleston, IL (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 120 days.

(21) Appl. No.: 10/386,207

(22) Filed: Mar. 11, 2003

(51) Int. Cl.[7] ..... F04B 27/08; F16D 31/02

(52) U.S. Cl. ..... 417/269; 92/71; 91/499; 60/484; 60/486

(58) Field of Search ..... 417/269; 91/499; 92/71; 60/464, 484, 486

(56) References Cited

U.S. PATENT DOCUMENTS

| | | | | |
|---|---|---|---|---|
| 3,643,433 A * | 2/1972 | Widmaier | | 60/486 |
| 3,680,312 A | 8/1972 | Forster | | |
| 4,252,508 A | 2/1981 | Forster | | |
| 4,426,911 A * | 1/1984 | Robinson et al. | | 91/35 |
| 5,957,229 A | 9/1999 | Ishii | | |
| 6,332,393 B1 | 12/2001 | Trimble | | |
| 6,425,244 B1 | 7/2002 | Ohashi et al. | | |
| 6,672,843 B1 * | 1/2004 | Holder et al. | | 417/201 |
| 2002/0033093 A1 * | 3/2002 | Nemoto | | 92/71 |

FOREIGN PATENT DOCUMENTS

| | | |
|---|---|---|
| JP | 2-135765 | 11/1990 |
| JP | 2000-9023 | 1/2000 |
| JP | 2001-146951 | 5/2001 |

* cited by examiner

*Primary Examiner*—Charles G. Freay
(74) *Attorney, Agent, or Firm*—Neal, Gerber & Eisenberg LLP

(57) ABSTRACT

A dual pump apparatus having two pumps mounted in a housing, where the housing comprises two elements mounted on opposite sides of a hydraulic mounting member or center section. The pumps are mounted on one side of the hydraulic mounting member in a pump cavity, and the center section and second housing element form a gear cavity in which gears to connect the two pump input shafts are located. Various charge pumps or auxiliary pump configurations are disclosed, including one embodiment where the input shaft gears themselves may act as a charge pump for the pump assembly.

17 Claims, 11 Drawing Sheets

DUAL PUMP

BACKGROUND OF THE INVENTION

This application relates in general to hydrostatic pumps and in particular to a dual pump arrangement. Hydrostatic pumps are well-known for use in driving vehicles such as tractors and other off-road devices. Such pumps are also used in a wide variety of industrial applications other than vehicles.

In one known arrangement for a vehicle, a plurality of pumps are mounted in separate housings on a vehicle frame. The pumps are each connected to a respective hydrostatic motor through high pressure hoses, which are often connected to end caps. The end cap is secured to the pump housing and includes a running surface for the pump and porting to connect the pump to the hoses.

A control arm is engaged to each hydrostatic pump to control the output of the pump. In a known design, the hydrostatic pump is of an axial piston design and the control arm is engaged to a swash plate, the rotation of which can change the output of the pump from forward to neutral to reverse. Rotation of the pumps is provided by rotary input shafts which are driven by the vehicle engine by pulleys and belts or other known methods. Each pump transmits hydraulic fluid through one of a pair of high pressure hoses to a hydrostatic motor. Rotational output of the motor is then transmitted to the vehicle drive wheels through an output axle or other known means.

Such an arrangement allows for zero turn capability, since the pumps may be operated independently of one another. However, there is a cost involved with this arrangement, as it requires at least four separate housings for the individual pumps and motors, and each housing must be individually secured to the vehicle frame.

Another known hydrostatic arrangement is the BDU transmission. This hydrostatic transmission comprises a single housing enclosing both a hydrostatic pump and a hydrostatic motor, both of which are mounted to a single plate. The pump input shaft and motor output shaft are parallel to one another, and the plate contains hydraulic porting to connect the pump and motor. One such hydrostatic transmission is shown in U.S. Pat. No. 5,392,670. Such an HST is generally used to connect to a drive train for powering output axles of a tractor or similar vehicle.

Another known dual pump design is shown in U.S. Pat. No. 6,672,843 entitled Dual Pump Transmission, owned by the assignee of this invention, and incorporated herein by reference.

SUMMARY OF THE INVENTION

It is an object of this invention to provide a lower cost hydrostatic pump design that can be used in, e.g., a zero turn vehicle, or in industrial applications. This invention in the preferred embodiment uses a dual pump design having two pumps mounted in a side-by-side arrangement.

Various benefits and objects of this invention are described below with respect to the figures. Additional benefits and objects of this invention will be apparent to those of skill in the art from a review of the following description and the drawings.

DETAILED DESCRIPTION OF THE DRAWINGS

Figure 1:
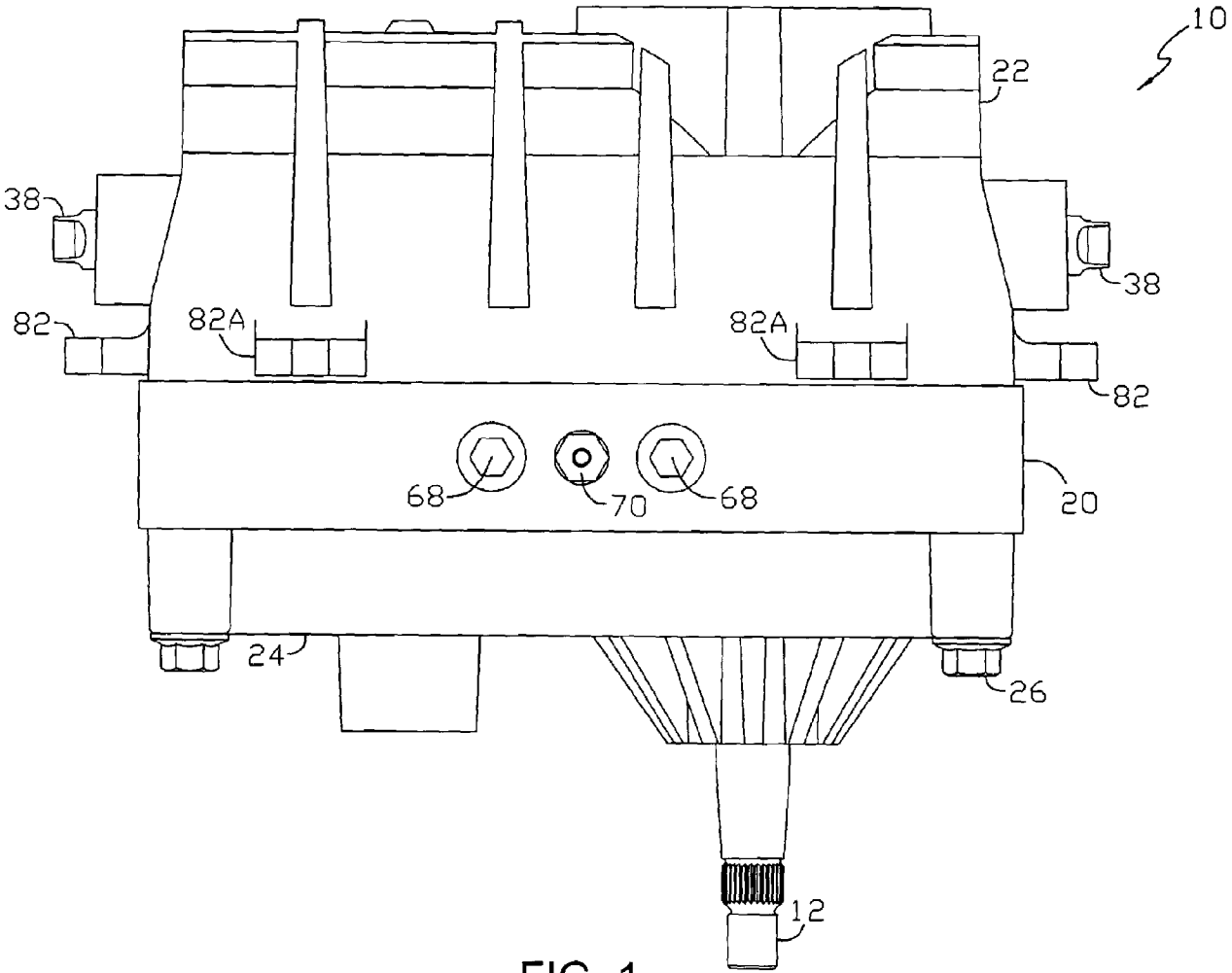
FIG. 1 is a side elevational view of a pump unit in accordance with the present invention.
Figure 2:
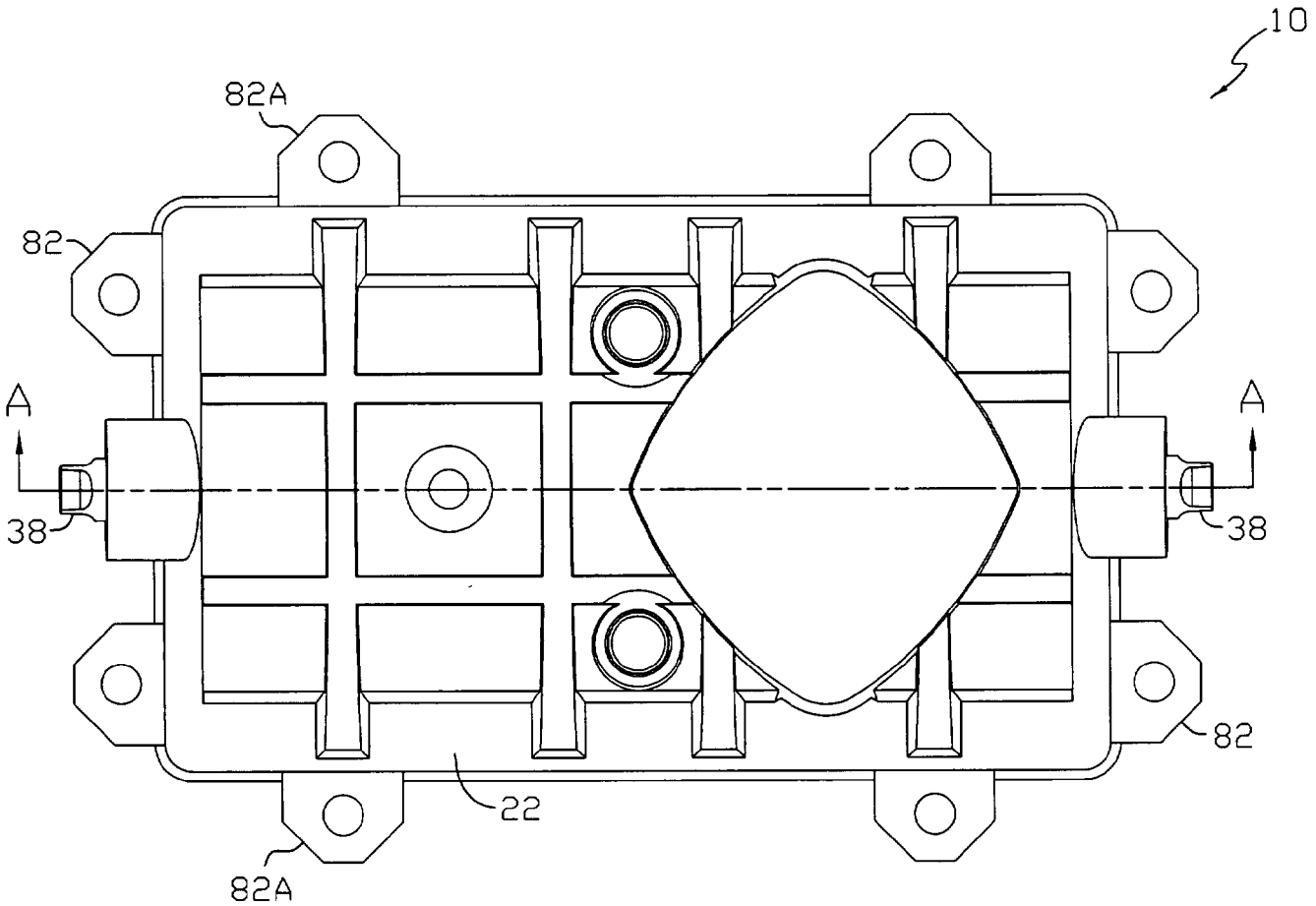
FIG. 2 is a top plan view of the pump unit shown in FIG. 1.
Figure 3:
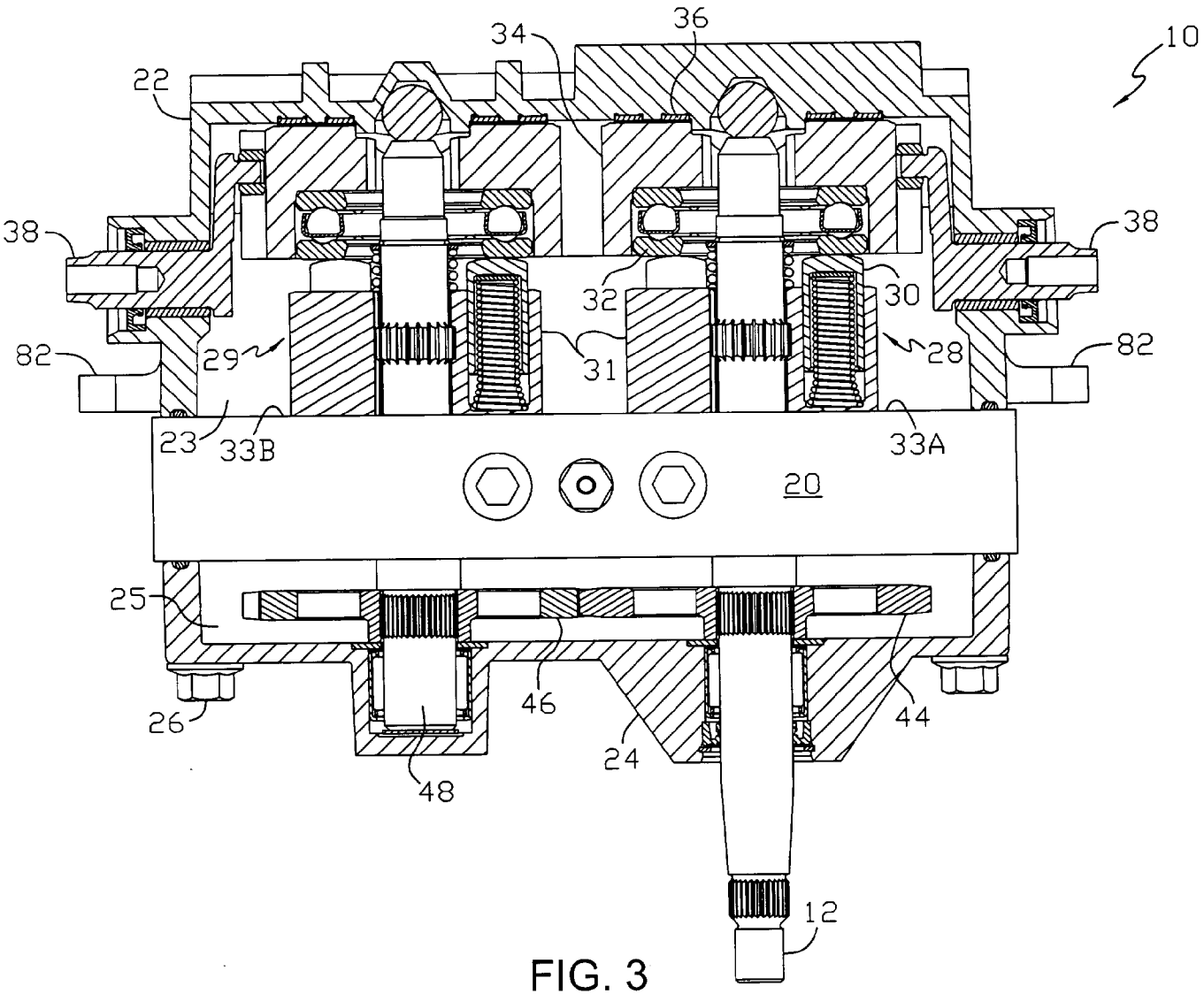
FIG. 3 is a cross-sectional side view along the lines A—A in FIG. 2.
Figure 9:
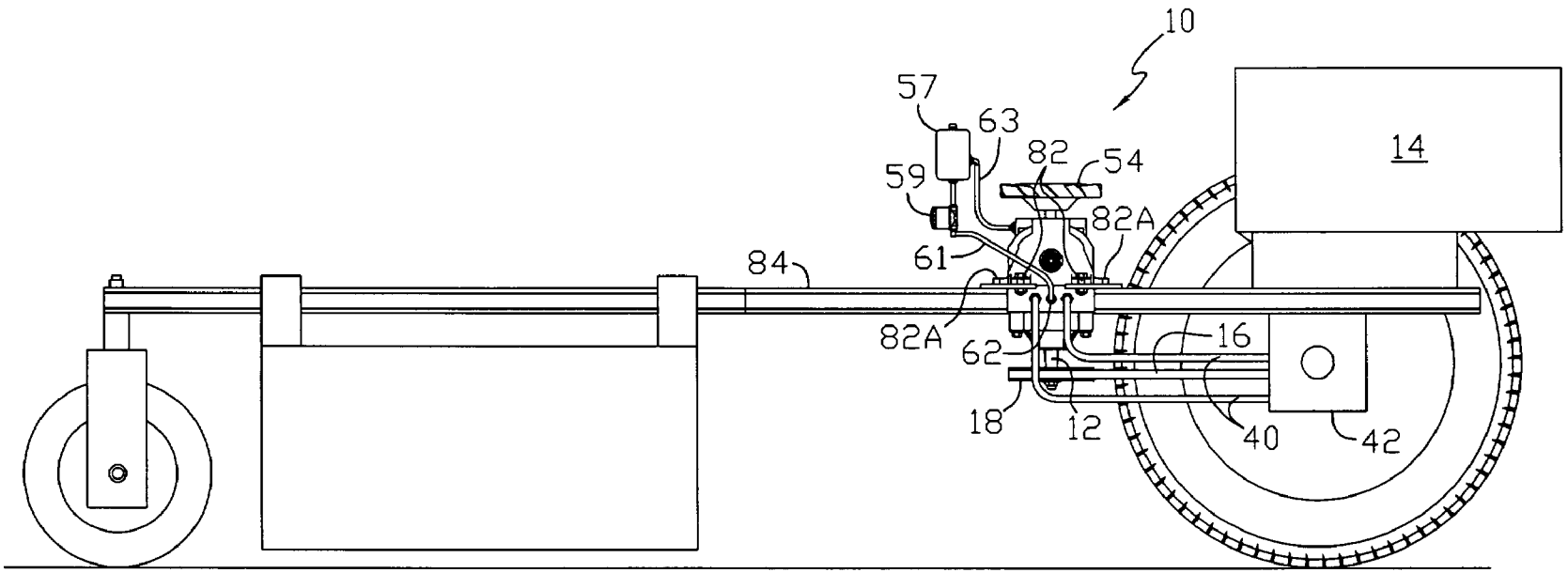
FIG. 9 is a side elevational view of a vehicle, shown schematically, incorporating the present invention.

A first embodiment of this invention is shown in FIGS. 1–3, which depict a dual pump unit 10 having a mounting member or center section 20 joined to housing members 22 and 24. As shown in FIG. 9, unit 10 may be secured to a vehicle deck 84 by means of mounting bosses 82 and 82A in the orientation shown, and a pulley 18 may be mounted on input shaft 12 to connect pump unit 10 with engine 14 through belt 16. Other connections between pump unit 10 and engine 14 may also be used. Hydraulic lines 40 are used to connect pump unit 10 to wheel motors 42, only one of which is shown in this view.

A plurality of bolts 26 may be used to secure housings 22 and 24 to center section 20. A first cavity 23 is formed by housing member 22 and center section 20, while a second cavity 25 is formed by center section 20 and housing 24. It will be understood that further alterations of these embodiments will be permissible within the scope of this invention. For example, while housing elements 22 and 24 are shown as separately secured to opposite faces of center section 20 it is possible that housing members 22 and 24 could be modified to engage with one another and center section 20 could be mounted in the same spatial relationship but secured inside the overall housing.

A pair of pump running surfaces 33A and 33B are formed on one surface of center section 20 and support axial piston pump assemblies 28 and 29, respectively. Pump assemblies 28 and 29 are located in cavity 23 which acts as a sump for the hydraulic fluid, and can be of a design known in the art. Pump assembly 28 comprises a plurality of pistons 30 mounted in a cylinder block 31 and engaged against thrust bearing 32, which is mounted in swash plate 34 riding on cradle bearings 36 and moveable between a variety of operable positions by means of a trunnion arm 38. Other known means of moving swash plate 34 could also be used in this invention. The structure and operation of the other pump assembly 29 is preferably identical.

First pump input shaft 12 extends out of housing 24 to be driven by pulley 18 or some other means. It is also engaged by means of gears 44 and 46 located in second cavity 25 to drive second pump shaft 48. Center section 20 is not shown in section in FIG. 3 simply to improve the clarity of this figure. The internal porting therein may be similar to that shown in U.S. Pat. No. 6,672,843.

Figure 4:
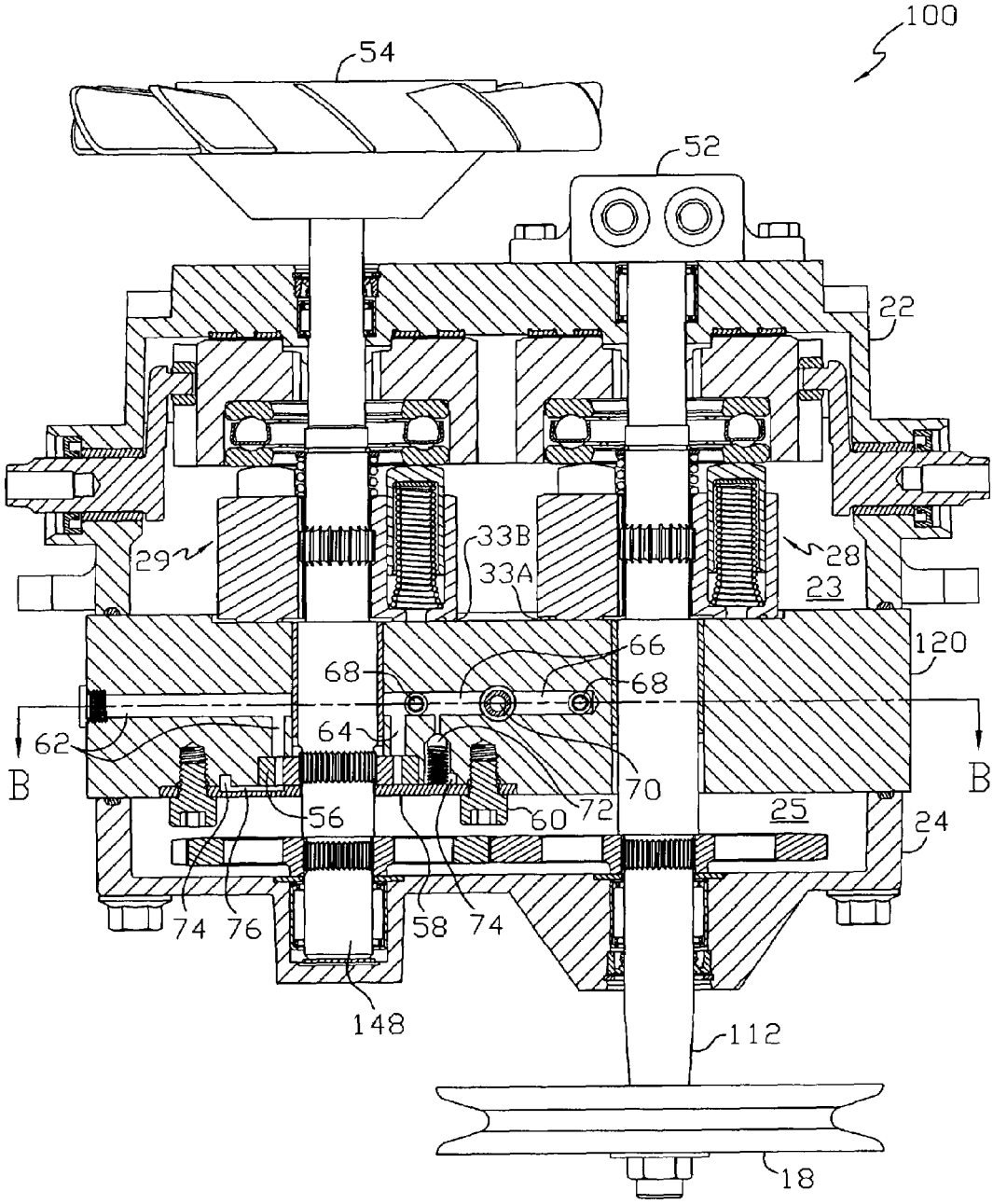
FIG. 4 is a cross-sectional side view of an alternative embodiment of the present invention.
Figure 5:
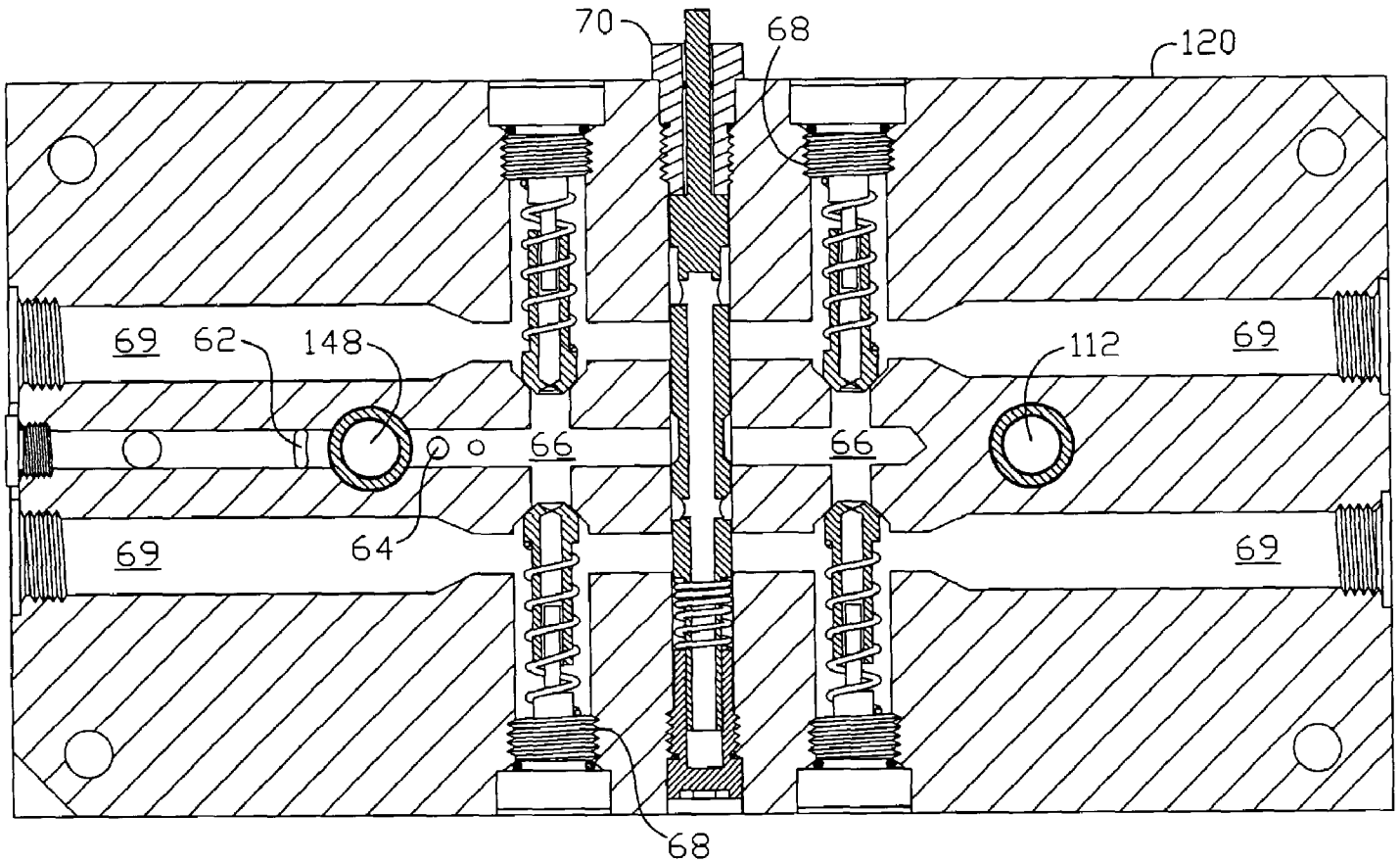
FIG. 5 is a cross-sectional plan view of the center section, along the lines B—B in FIG. 4.

FIGS. 4 and 5 depict pump unit 100, which is an alternative embodiment of this invention generally similar to that shown in FIGS. 1–3, with the addition of various optional features, which may be combined as depicted in this view or used individually within the spirit of this invention.

Figure 6:
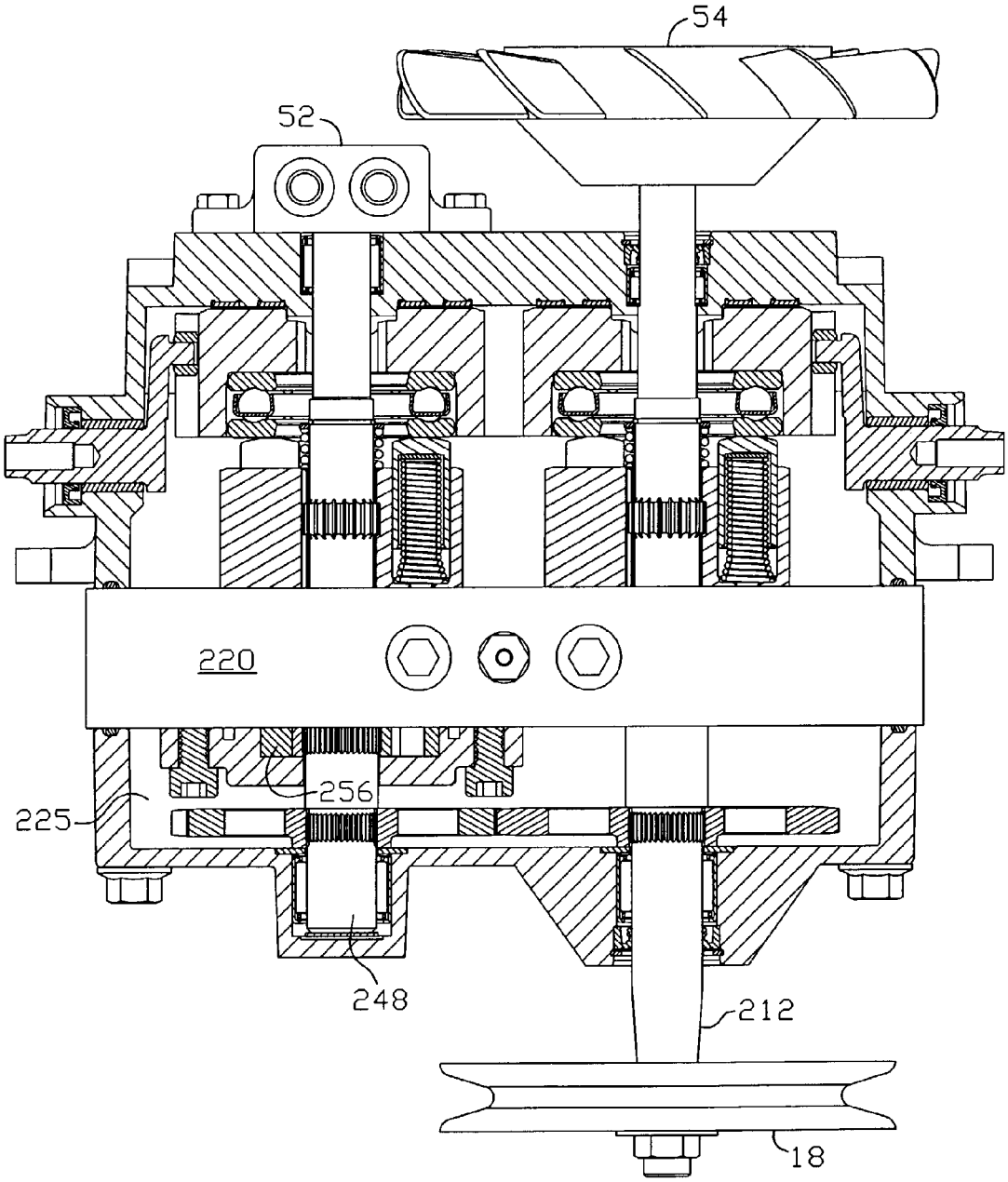
FIG. 6 is a cross-sectional side view of another alternative embodiment of the present invention.

In this embodiment, input shaft 112 also extends through housing 22 to power an auxiliary pump 52, which may be used to drive features such as a deck lift, auger drive or the like (not shown). Auxiliary pump 52 could also be mounted on housing 24 adjacent to pulley 18 and be driven by input shaft 112. As shown in FIG. 6, auxiliary pump 52 could also be driven by second input shaft 248.

A further feature is the use of fan 54 to cool pump unit 100. As shown in FIG. 4, fan 54 is mounted on an end of second pump shaft 148 which extends out of housing 22. Fan 54 could also be located in other locations, such as the opposite end of shaft 148, adjacent pulley 18 on shaft 112 or in the location of auxiliary pump 52 on shaft 112, such as is shown in FIG. 6. Multiple fans 54 could be used by offsetting the height of the fans or decreasing their diameter, if needed based on application requirements.

Another unique feature of this design is the use of charge pump 56 which is driven by pump shaft 148 and is located in a cavity formed in center section 120 by cover 58. Cover 58 is secured to center section 120 by means of fasteners 60. Charge pump 56 is preferably a gerotor style charge pump and communicates with charge gallery 66 by means of passages 64. Hydraulic fluid is communicated to porting 69 by means of check plugs 68.

Charge pump inlet 62 provides hydraulic fluid to charge pump 56 from an external sump 57 through filter 59 and hoses 61. In configurations utilizing an external sump 57 and a charge pump, a case drain 63 should also be included to connect the first cavity 23 to the external sump 57. While FIG. 9 shows such connection on an upper portion of dual pump unit 10, such connection may also be from any portion of dual pump unit 10 connected with first cavity 23, such as center section 20 or housing 24. Generally some means of relieving excess charge pressure is required. Charge relief 72 relieves excess pressure in charge gallery 66 through passage 74, which is annularly positioned about charge pump 56. Passage 74 is then connected via passage 76 to the inlet of charge pump 56. Connecting the relieved charge pressure through cover 58 allows the passage to be formed via various net-shape manufacturing technologies, thus reducing cost. When such passages are formed within center section 120 they are often machined due to the difficulty of forming and maintaining these features during casting, which thus increases cost of fabricating center section 120. A bypass valve 70 is also provided to permit oil to flow from one side of porting 69 to the other side thereof. Other features of such a dual pump arrangement would be known to one of skill in the art.

One could also use a return to neutral mechanism with this design in a known manner, such as that described and shown in U.S. Pat. No. 6,487,857 entitled "Zero-Turn Transaxle with Mounted Return to Neutral Mechanism," the terms of which are incorporated herein by reference.

Another embodiment of this invention is shown in FIG. 6, where charge pump 256 is mounted inside cavity 225 but external to center section 220. In this view, center section 220 is not shown in section for purposes of clarity, but internal passages similar to those shown in FIG. 4 would be used therein. As noted previously, FIG. 6 also shows cooling fan 54 mounted on input shaft 212 and auxiliary pump 52 mounted on section pump shaft 248 as further optional embodiments of this invention.

Figure 7:
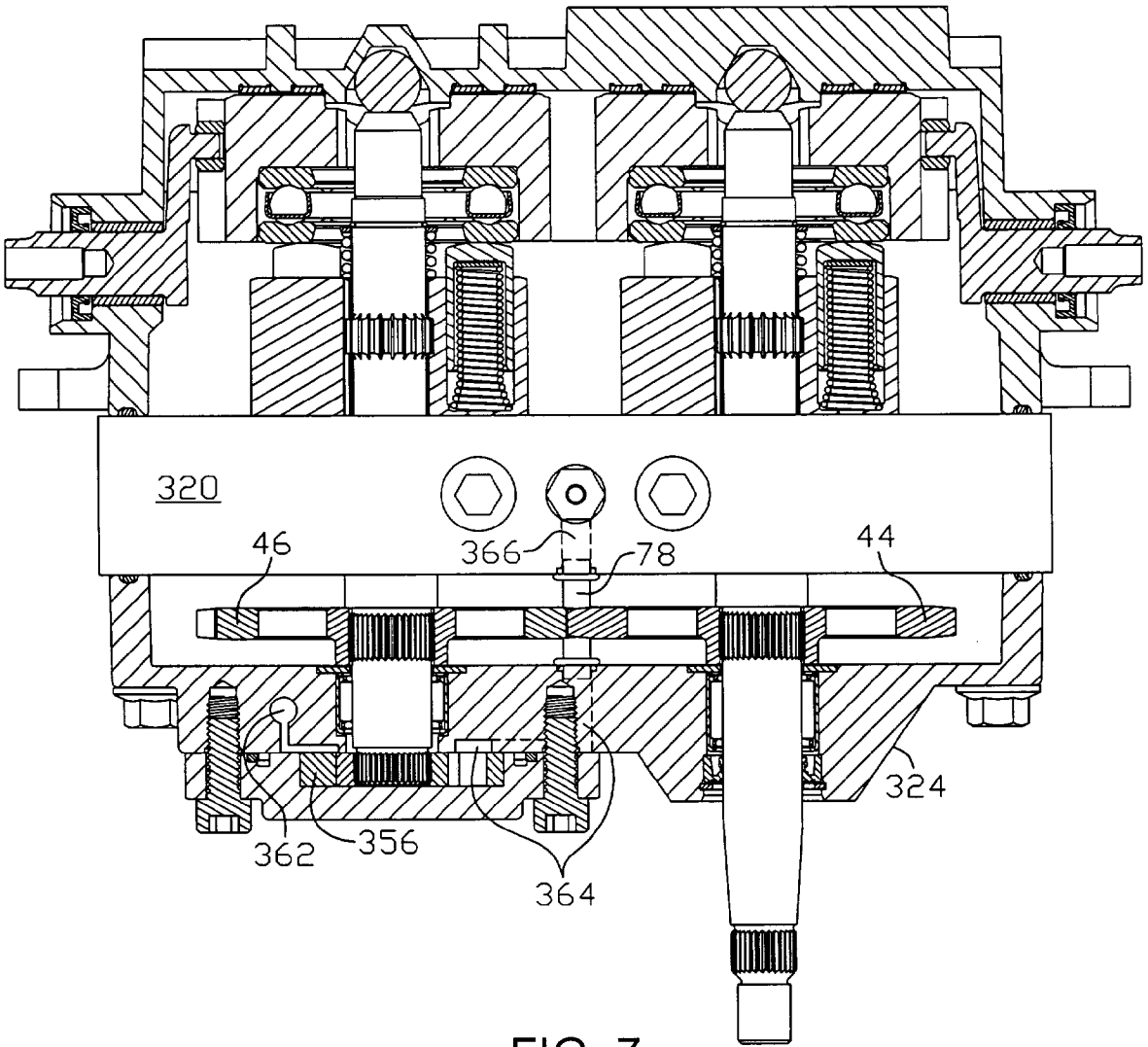
FIG. 7 is a cross-sectional side view of another alternative embodiment of the present invention.

FIG. 7 shows another embodiment of a charge pump in accordance with the present invention, where charge pump 356 is mounted external to housing 324, charge inlet 362 is formed in housing 324 to provide charge fluid to charge pump 356; the charged fluid is then directed via passage 364 through connecting tube 78 positioned adjacent to gears 44 and 46 and is then provided to charge gallery 366 formed in center section 320. It will be understood that charge connecting tube 78 could be of various designs, but it is preferable that it be closely fit to mating holes in both housing 324 and center section 320 to minimize leakage of the pressurized fluid; gaskets or seals could also be used to minimize such leakage.

Figure 8:
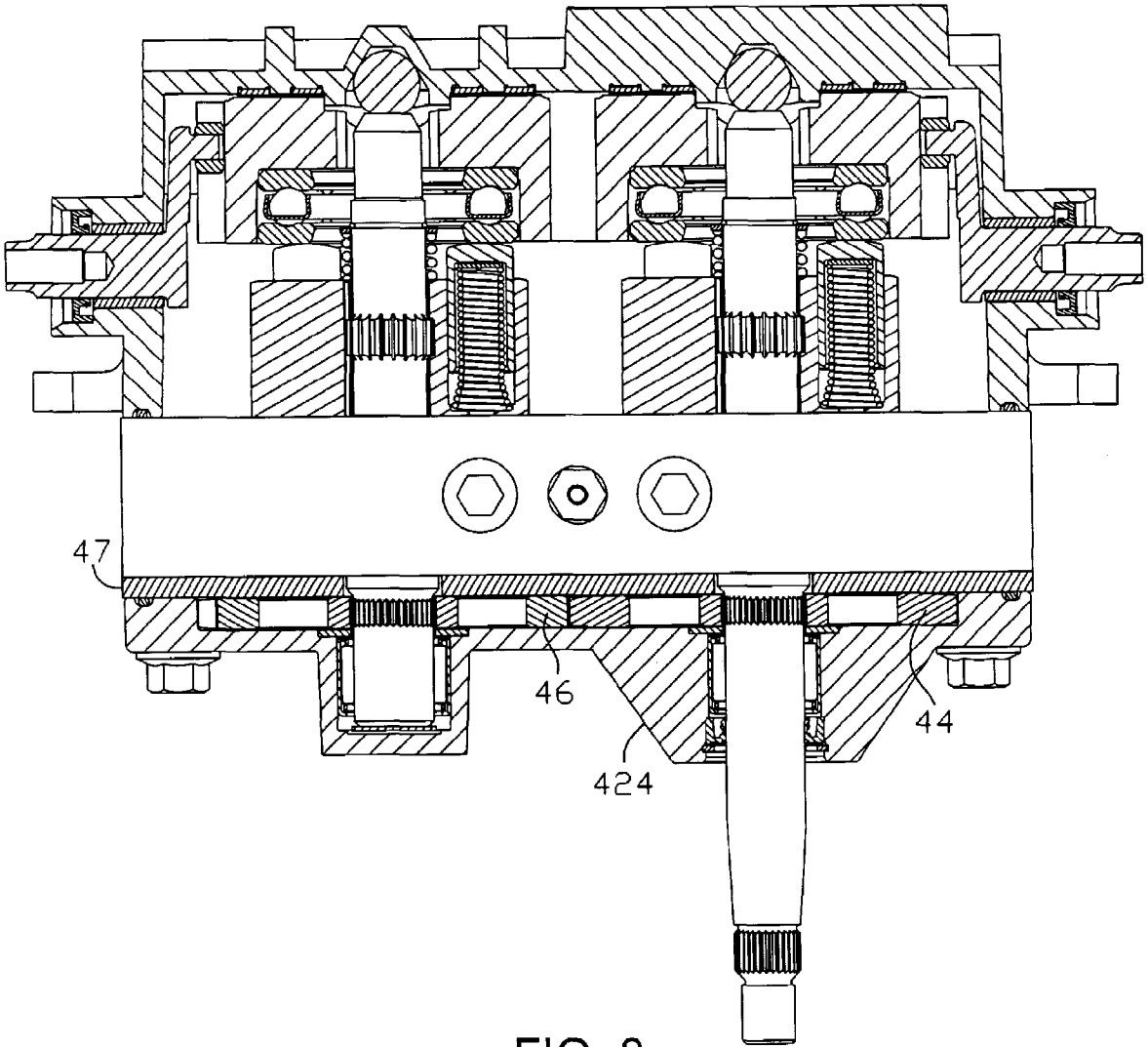
FIG. 8 is a cross-sectional side view of another alternative embodiment of the present invention.

A further alternative embodiment is shown in FIG. 8 where gears 44 and 46 act as the charge pump. A charge plate 47 is used adjacent to center section 420 to separate the charge gallery from the gear pump and the fluid inlets.

Figure 10:
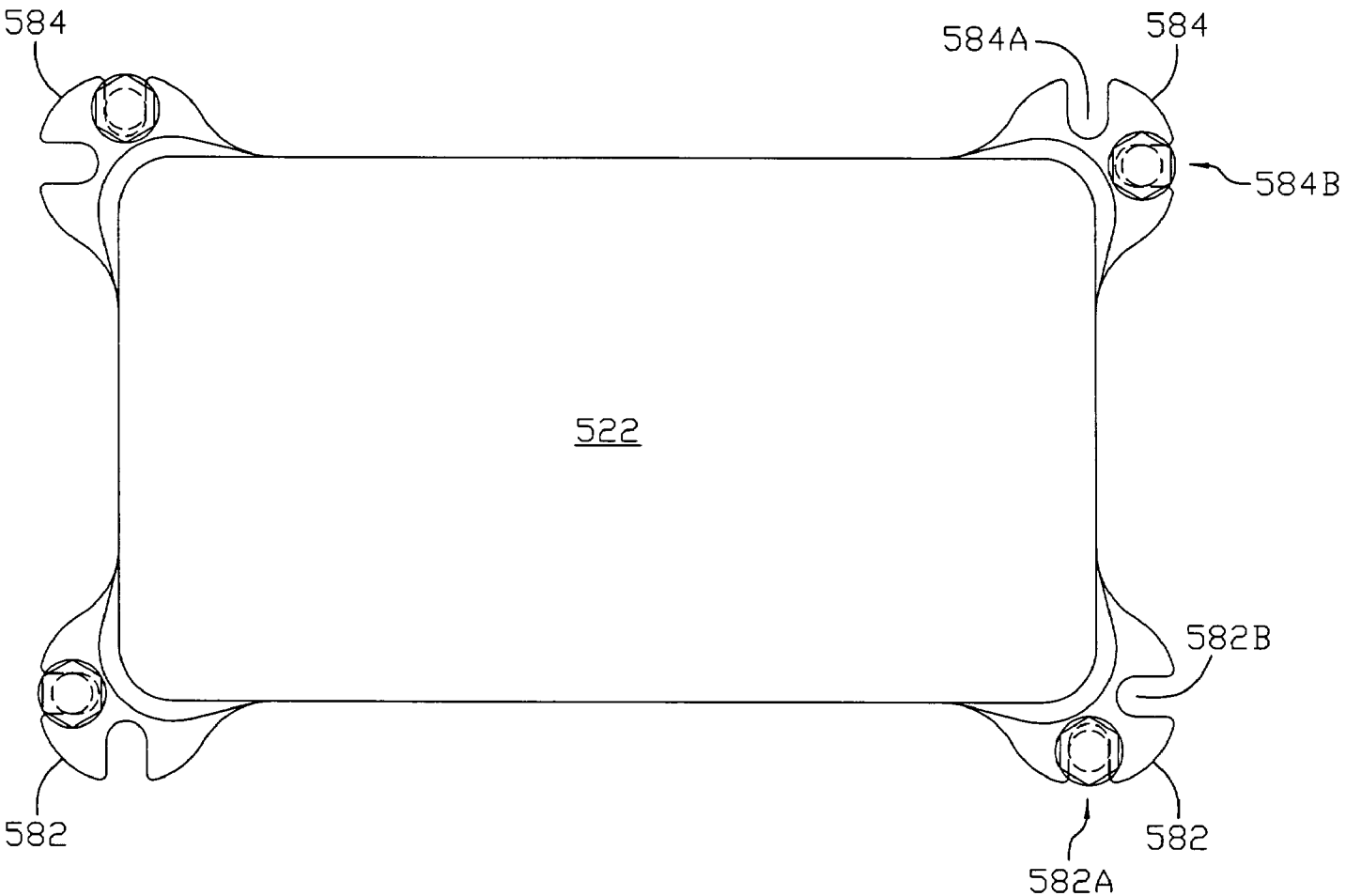
FIG. 10 is a plan view of a housing for use with the present invention.

Standard mounting techniques such as that shown in FIG. 2 may provide substantial stability in one direction or the orthogonal direction, but in order to achieve maximum stability during operation, often all eight mounting locations 82 and 82A may be required. In order to improve mounting stability with minimal fastening locations an alternative embodiment shown in FIG. 10 is provided. Maintaining the mounting bosses 582 and 584 in the extreme corners of the upper housing, and providing two mounting locations in each boss, allows creation of a mounting pattern with improved stability. By selecting the "A" position in one boss and the "B" position in another boss, for example mounting using position 582A and position 584B as shown, provides an improved mounting footprint with a minimal number of fasteners.

Figure 11:
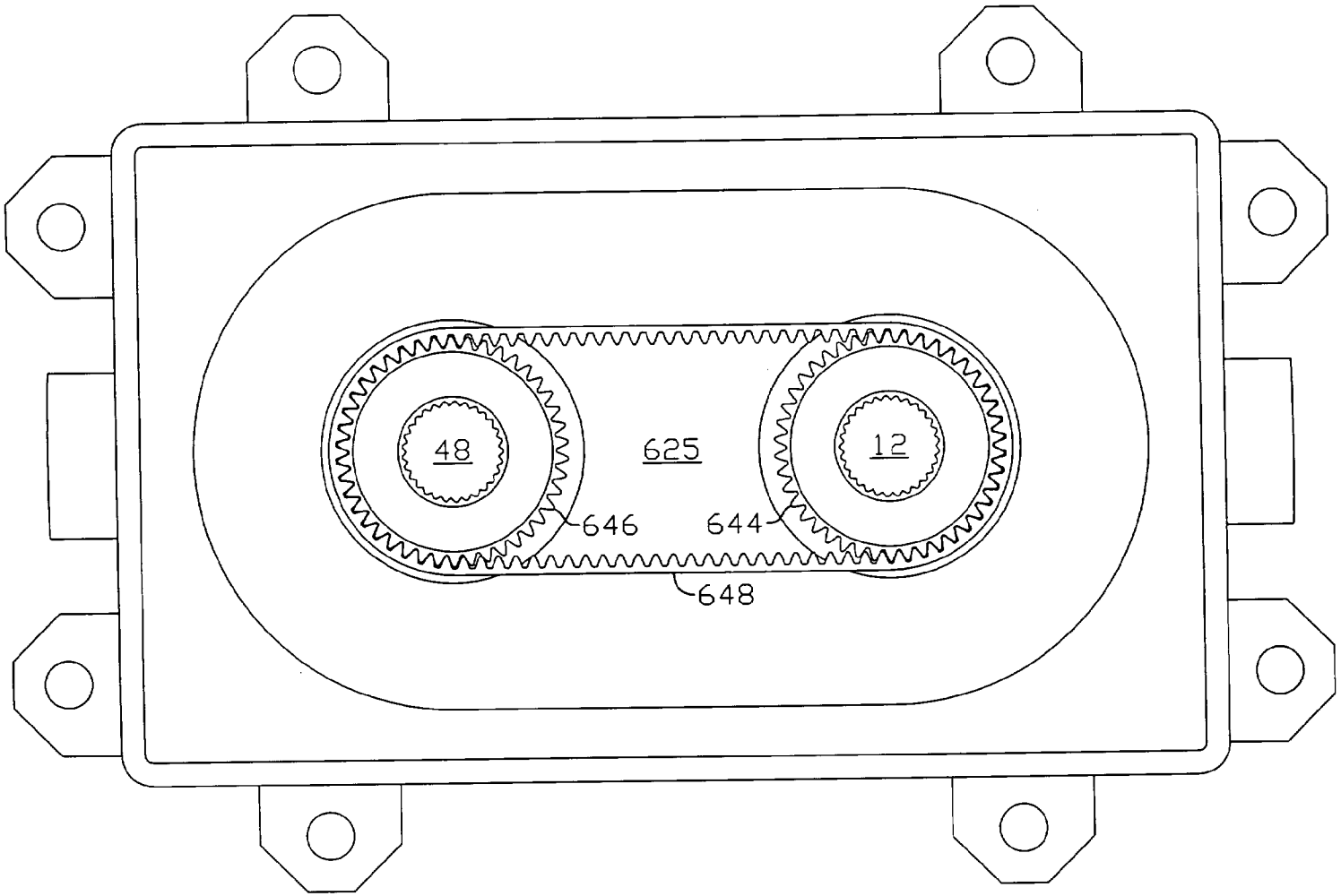
FIG. 11 is a plan view of a toothed belt for use with the present invention.

Another problem with known dual pump designs is that operation of connecting gears 44 and 46 in an oil-filled compartment creates substantial efficiency losses due to the speed of the rotation of gears 44 and 46 and the requisite movement of the oil caused thereby. An alternative connection means is disclosed in FIG. 11, where connecting gears 44 and 46 have been replaced by toothed pulleys 644 and 646, which drive a toothed belt 648. In such a configuration compartment 625 would not be filled with oil or grease, and would be independent of the internal oil sump containing the hydraulic pumps 28 and 29. Furthermore, in some applications toothed pulleys 644 and 646 may be replaced with pulleys and a belt. Note that toothed pulleys 644 and 646 may also drive a chain, in which case compartment 625 would likely contain grease or oil.

While specific embodiments of the invention have been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

We claim:

1. A pump apparatus comprising:

a hydraulic mounting member having a first side and a second side formed opposite to the first side;

a first housing member mounted to the first side of the hydraulic mounting member and defining a pump cavity therein;

a second housing member mounted to the second side of the hydraulic mounting member and defining a gear cavity therein;

first and second hydraulic pumps rotatably mounted in the pump cavity on the first side of the hydraulic mounting member;

a first input shaft engaged to and driving the first hydraulic pump and having a first end and a second end, where the second end extends out of the second housing member and is engaged to and driven by a prime mover;

a second input shaft engaged to and driving the second hydraulic pump and having a first end and a second end;

a first gear driven by the first input shaft and a second gear mounted on the second input shaft, where the first and second gears are located in the gear cavity.

2. A pump apparatus as set forth in claim 1, further comprising a charge pump mounted on the second side of the hydraulic mounting member.

3. A pump apparatus as set forth in claim 2, wherein the charge pump is driven by the first input shaft.

4. A pump apparatus as set forth in claim 2, wherein the charge pump is driven by the second input shaft.

5. A pump apparatus as set forth in claim 1, wherein the first end of the first input shaft is located in the pump cavity.

6. A pump apparatus as set forth in claim 1, wherein the first end of the first input shaft extends out of the first housing member and further comprising an auxiliary pump located on the first housing member and driven by the first end of the first input shaft.

7. A pump apparatus as set forth in claim 1, wherein the second end of the second input shaft is located in the pump cavity.

8. A pump apparatus as set forth in claim 1, wherein the first end of the second input shaft extends out of the first housing member and the apparatus further comprises a fan mounted on and driven by the first end of the second input shaft.

9. A pump apparatus as set forth in claim 8, further comprising a charge pump driven by the second input shaft and mounted on the second side of the hydraulic mounting member.

10. A pump apparatus as set forth in claim 1, wherein the first side of the hydraulic mounting member is generally rectangular.

11. A pump apparatus comprising:

a hydraulic mounting member having a first side and a second side formed opposite to the first side;

a first housing member mounted to the first side of the hydraulic mounting member and defining a pump cavity therein;

a second housing member mounted to the second side of the hydraulic mounting member and defining a gear cavity therein;

first and second hydraulic pumps rotatably mounted in the pump cavity on the first side of the hydraulic mounting member;

a first input shaft engaged to and driving the first hydraulic pump and having a first end extending out of the first housing member and a second end extending out of the second housing member, wherein the second end is engaged to and driven by a prime mover;

a second input shaft engaged to and driving the second hydraulic pump and having a first end and a second end, wherein the second end is located in the gear cavity;

a first gear driven by the first input shaft and a second gear mounted on the second input shaft, where the first and second gears are mounted in the gear cavity.

12. A pump apparatus for use in a vehicle having a frame, the pump apparatus comprising:

a pump housing comprising a first housing member having a mounting surface for connecting the pump housing to the vehicle frame and a second housing member located below the mounting surface;

a hydraulic mounting member secured to the pump housing and located below the mounting surface, the mounting member comprising hydraulic porting formed therein, a first side having a running surface formed thereon and a second side formed opposite to the first side, wherein the first housing member is mounted to the first side of the hydraulic mounting member and defines a sump therein and the second housing member is mounted to the second side of the hydraulic mounting member;

first and second hydraulic pumps rotatably mounted in the sump on the running surface of the hydraulic mounting member;

a first input shaft engaged to and driving the first hydraulic pump and having a first end and a second end, where the second end extends out of the second housing member and is engaged to and driven by a prime mover; and a second input shaft engaged to and driving the second hydraulic pump and having a first end and a second end.

13. A pump apparatus as set forth in claim 12, further comprising a first gear driven by the first input shaft and a second gear mounted on the second input shaft, where the first and second gears are located in a gear cavity formed by the second housing member and the hydraulic mounting member.

14. A pump apparatus as set forth in claim 13, further comprising a charge pump mounted on the second side of the hydraulic mounting member.

15. A pump apparatus as set forth in claim 14, wherein the first end of the second input shaft extends out of the first housing member and the apparatus further comprises a fan mounted on and driven by the first end of the second input shaft.

16. A pump apparatus as set forth in claim 14, comprising a plurality of mounting surfaces formed on the first housing member, wherein each mounting surface has at least two openings to receive a fastener to secure the first housing member to the vehicle frame.

17. A pump apparatus as set forth in claim 16, wherein the first housing member is secured to the frame by a fastener secured in one of the openings in each mounting surface.

* * * * *